US005922526A

United States Patent [19]

Missfeldt

[11] Patent Number: 5,922,526

[45] **Date of Patent: *Jul. 13, 1999**

[54] COLOUR PHOTOGRAPHIC MATERIAL

[75] Inventor: Michael Missfeldt, Leichlingen, Germany

[73] Assignee: Agfa-Gevaert AG, Germany

[ * ] Notice: This patent is subject to a terminal disclaimer.

[21] Appl. No.: 08/964,281

[22] Filed: Nov. 4, 1997

[30] Foreign Application Priority Data

Nov. 13, 1996 [DE] Germany ..... 196 46 855

[51] Int. Cl.[6] ..... G03C 1/14

[52] U.S. Cl. ..... 430/584; 430/611; 430/613

[58] Field of Search ..... 430/584, 611, 430/613, 585

[56] References Cited

FOREIGN PATENT DOCUMENTS 599 383 11/1993 European Pat. Off. .
599 384 11/1993 European Pat. Off. .

*Primary Examiner*—Thorl Chea
*Attorney, Agent, or Firm*—Connolly & Hutz

[57] ABSTRACT

A color photographic recording material having at least one light-sensitive silver halide emulsion layer, the silver halide emulsion whereof is spectrally sensitized with a cyanine dye of the formula I, exhibits increased sensitivity, (I)

Q $R^1$, $R^2$, $R^3$, $R^6$ to $R^9$ are H, halogen, alkyl, methoxy, aryl, 1-pyrrolyl, 2-pyrrolyl, 3-pyrrolyl, 2-furanyl, 3-furanyl, 2-thienyl, 3-thienyl, 1-indolyl, 2-isoindolyl or N-carbazolyl; or $R^7$ together with $R^6$ or $R^8$ denote the group required to complete an optionally substituted fused benzene ring or napthylene ring system;

$R^4$ and $R^5$ are alkyl, sulphoalkyl, carboxyalkyl, —$(CH_2)_n$—$SO_2$—NH—$SO_2$-alkyl, —$(CH_2)_n$—$SO_2$—NH—CO-alkyl, —$(CH_2)_n$—CO—NH—$SO_2$-alkyl, or —$(CH_2)_n$—CO—NH—CO-alkyl;

X denotes —O—, —S—, —Se—, or —$NR^{10}$ ($R^{10}$= optionally substituted alkyl);

$L^1$, $L^2$, $L^3$ denote substituted or unsubstituted methine groups, or one or more carbocyclic rings;

A is H, an aromatic group or, together with B, is the group required to complete a fused benzene ring;

B either together with A or together with C is the group required to complete a fused benzene ring;

C is H, an aromatic group or, together with B or D, is the group required to complete a fused benzene ring, D is H, an aromatic group or, together w the C, is the group required to complete a fused benzene ring;

Q is an anion or cation m is 1, 2, 3 or 4.

8 Claims, No Drawings

COLOUR PHOTOGRAPHIC MATERIAL

The present invention relates to a colour photographic recording material having at least one silver halide emulsion layer spectrally sensitised with a cyanine dye.

The improvement of the spectral sensitivity of photographic materials is a permanent challenge. With the use of polymethine dyes it is possible to extend the sensitivity beyond the inherent sensitivity range. Cyanines are particularly suitable for this. EP-A 0 599 383 and EP-A 0 599 384 describe benzothiazolemonomethine cyanines which have at least one 5-membered heterocycle (furanyl, thienyl, pyrrolyl) as a substituent on the benzene nucleus and lead to good spectral sensitivities on silver halide emulsions.

It has been found that through the use of benzothiazole-containing cyanines corresponding to the general formula I, which have on the benzene nucleus at least one substituted or unsubstituted indolyl substituent or one substituted or unsubstituted isoindolyl substituent or one substituted or unsubstituted carbazolyl substituent, the spectral sensitivities obtained are higher in comparison with the corresponding cyanine dyes having pyrrole substituents.

(I)

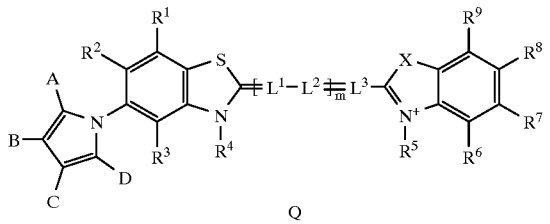

wherein $R^1$, $R^2$, $R^3$, $R^6$ to $R^9$ (alike or different) denote: H, halogen, alkyl, methoxy, aryl, 1-pyrrolyl, 2-pyrrolyl, 3-pyrrolyl, 2-furanyl, 3-furanyl, 2-thienyl, 3-thienyl, 1-indolyl, 2-isoindolyl or N-carbazolyl; or $R^7$ together with $R^6$ or $R^8$ denote the group required to complete an optionally substituted fused benzene ring or naphthalene ring system;

$R^4$ and $R^5$ (alike or different) denote: alkyl, sulphoalkyl, carboxyalkyl, —$(CH_2)_n$—$SO_2$—NH—$SO_2$-alkyl, —$(CH_2)_n$—$SO_2$—NH—CO-alkyl, —$(CH_2)_n$—CO—NH—$SO_2$-alkyl, or —$(CH_2)_n$—CO—NH—CO-alkyl (n=1–6);

X denotes —O—, —S—, —Se— or —$NR^{10}$ ($R^{10}$= optionally substituted alkyl);

$L^1$, $L^2$, $L^3$ denote substituted or unsubstituted methine groups, which may be constituents of one or more carbocyclic rings;

A denotes H, an aromatic group or, together with B, denotes the group required to complete a fused benzene ring;

B either together with A or together with C denotes the group required to complete a fused benzene ring;

C denotes H, an aromatic group or, together with B or D, denotes the group required to complete a fused benzene ring;

D denotes H, an aromatic group or, together with C, denotes the group required to complete a fused benzene ring;

Q denotes an anion or cation which may if necessary be required to equalise the charge;

m is 1, 2, 3 or 4.

An alkyl group represented by one of the groups $R^1$ to $R^3$ and $R^6$ to $R^9$ is straight-chain or branched and contains up to 4C atoms. The preferred example of this is methyl. An alkyl group represented by or contained within $R^4$ or $R^5$ is straight-chain or branched and contains up to 6C atoms.

An aryl group represented by one of the groups $R^1$ to $R^3$ and $R^6$ to $R^9$ is preferably phenyl, or phenyl substituted, for example, with halogen, alkyl and/or alkoxy-substituted phenyl.

Examples of substituents on a benzene ring or naphthalene ring system completely fused with the participation of two of the groups $R^6$, $R^7$ and $R^8$ are halogen, in particular chlorine; alkyl and alkoxy.

Where a fused benzene ring is completed with the participation of A and B, then C and D preferably represent H or the two together likewise represent the group required to complete a fused benzene ring. Where a fused benzene ring is completed with the participation of B and C, then at least one of the groups A and D preferably represents an aromatic group. An aromatic group represented by A, C or D is in particular an unsubstituted phenyl group, or a phenyl group substituted, for example, with halogen, alkyl or alkoxy. A benzene ring completely fused with the participation of two of the groups A, B, C or D may be substituted, for example, with halogen, alkyl or alkoxy.

Suitable examples of sensitisers according to the invention are shown below.

(I)-1

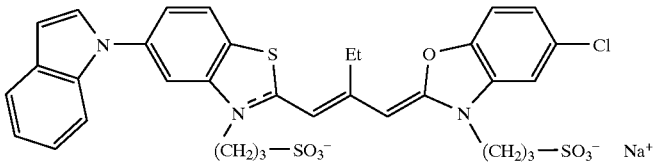

(I)-2

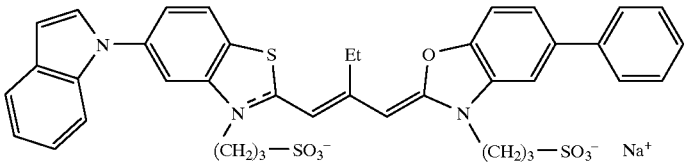

-continued
(I)-3
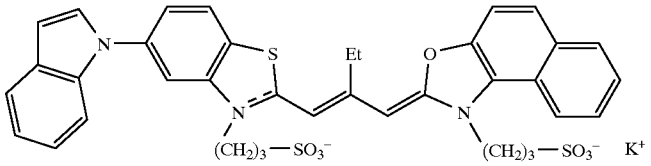
(I)-4
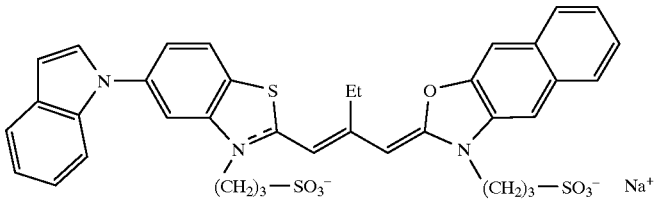
(I)-5
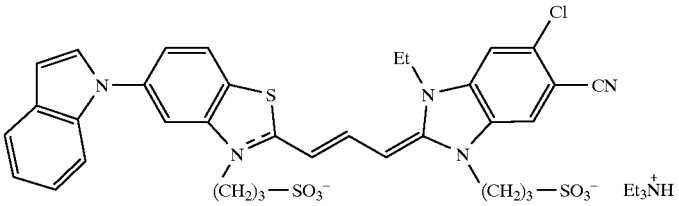
(I)-6
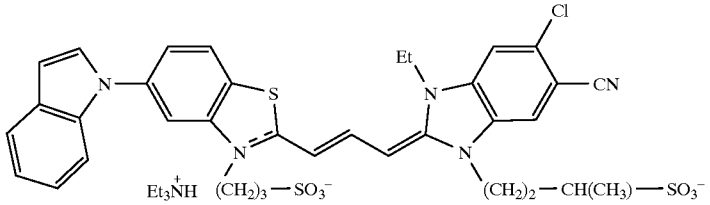
(I)-7
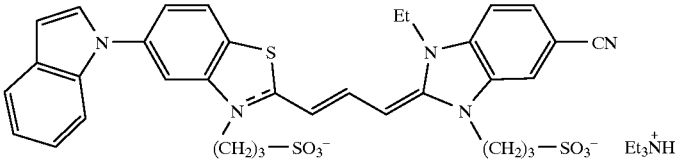
(I)-8
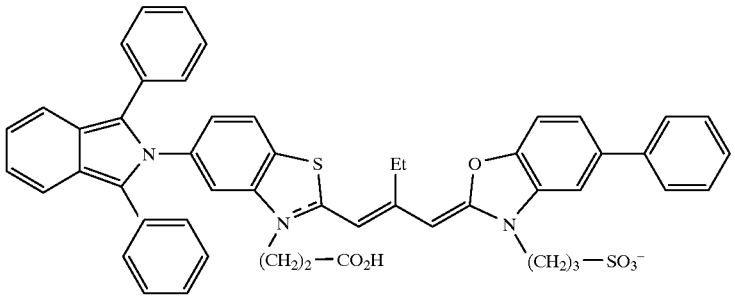

-continued
(I)-9
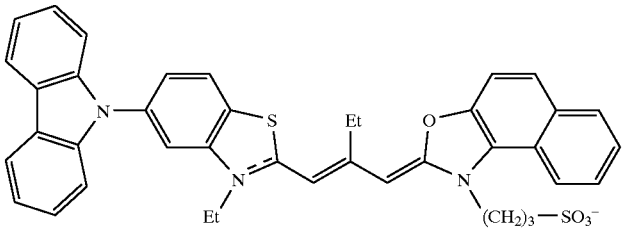
(I)-10
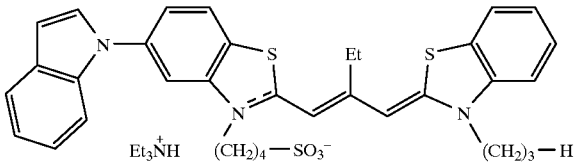
(I)-11
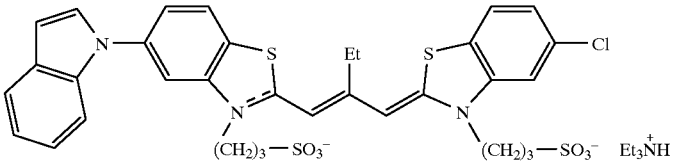
(I)-12
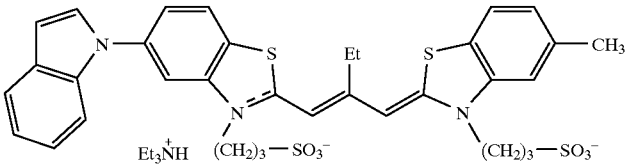
(I)-13
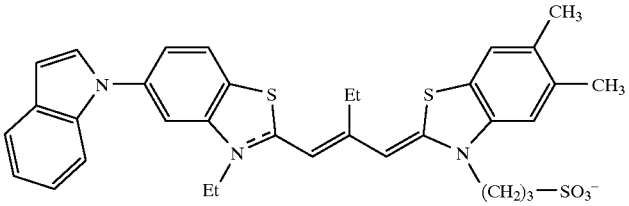
(I)-14
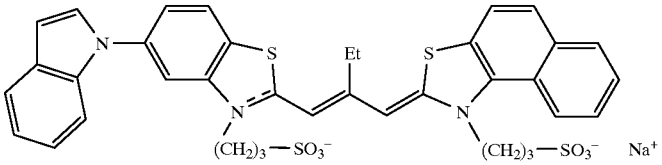
(I)-15
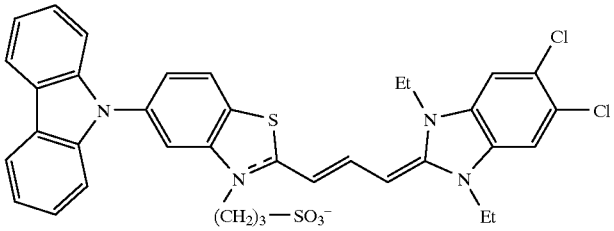

-continued
(I)-16
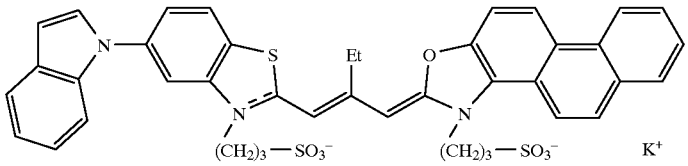
(I)-17
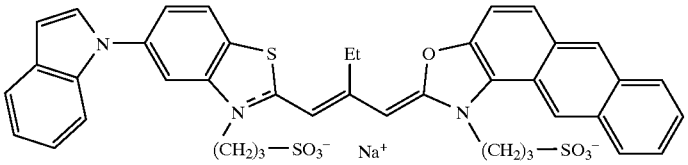
(I)-18
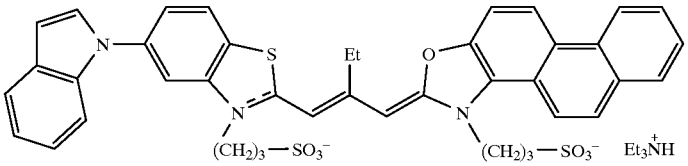
(I)-19
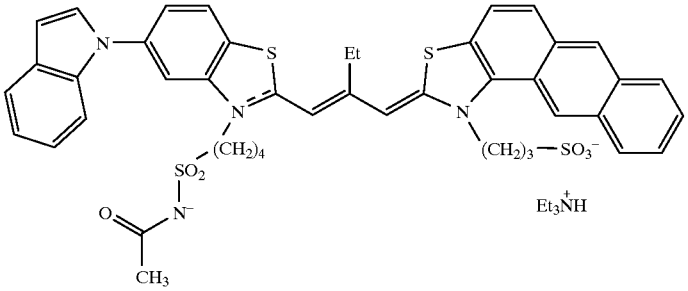
(I)-20
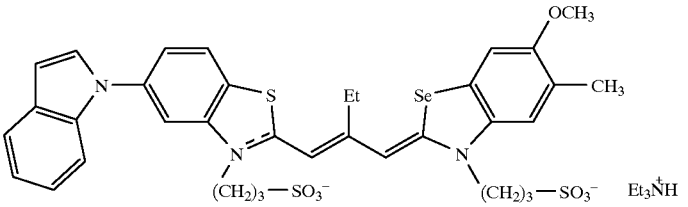
(I)-21
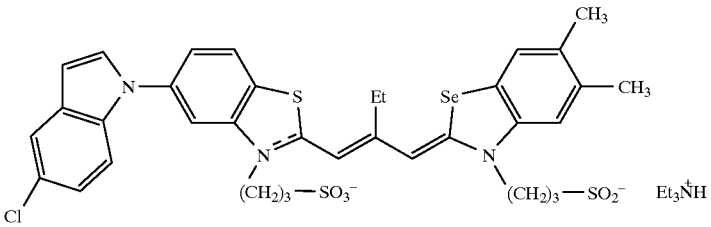

-continued
(I)-22
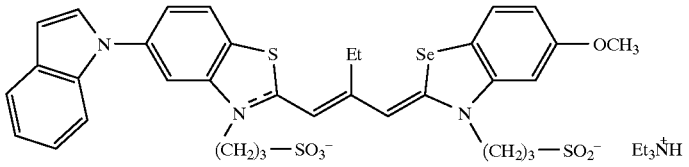
(I)-23
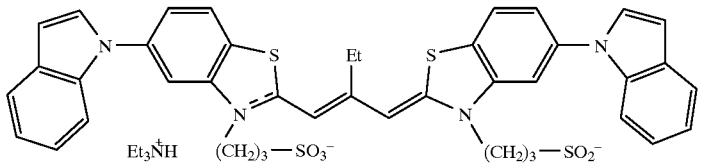
(I)-24
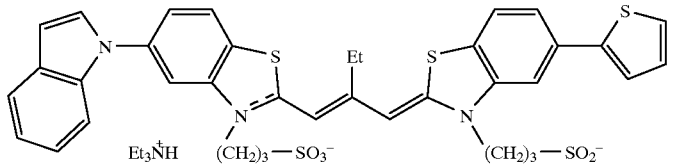
(I)-25
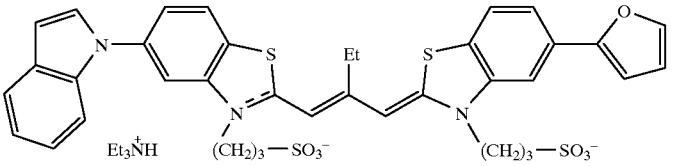
(I)-26
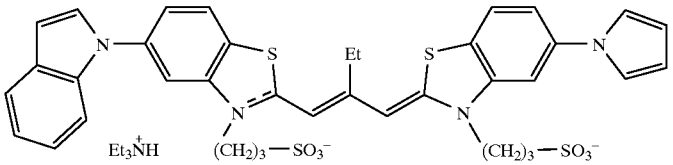
(I)-27
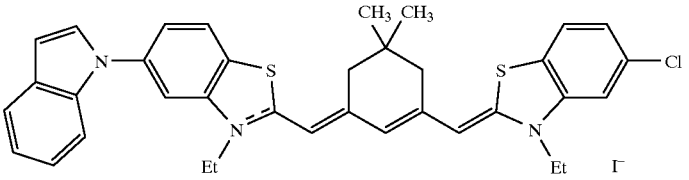
(I)-28
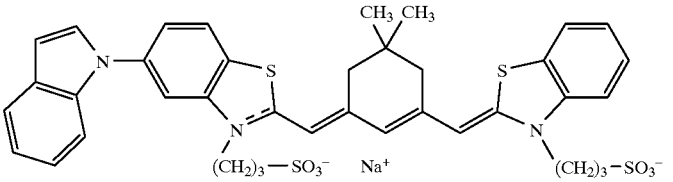

-continued
(I)-29
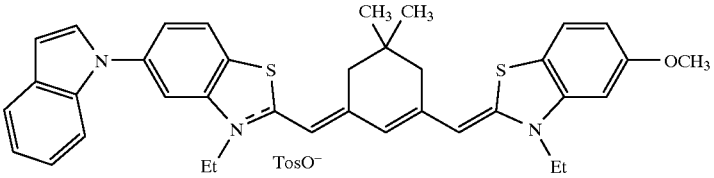
(I)-30
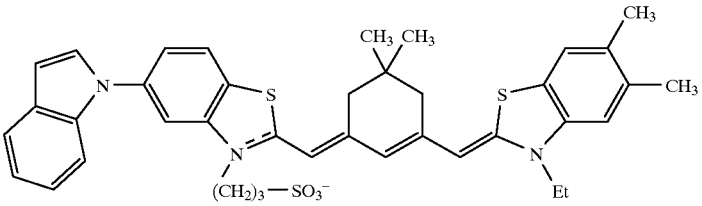
(I)-31
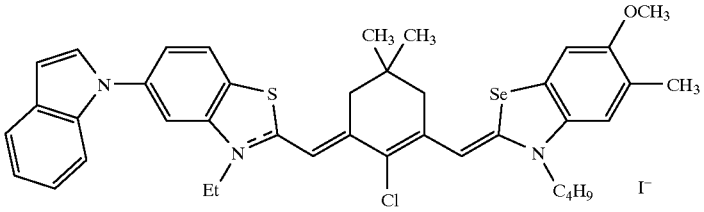
(I)-32
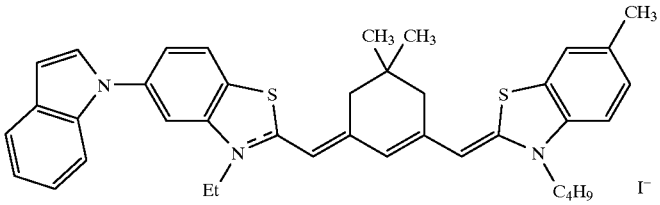
(I)-33
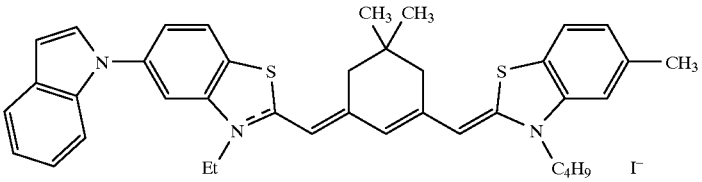
(I)-34
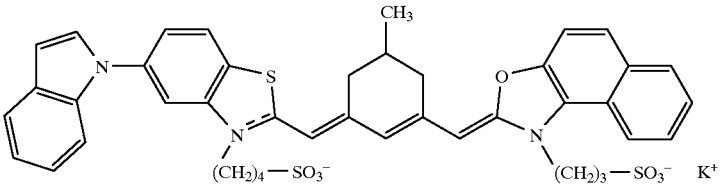
(I)-35
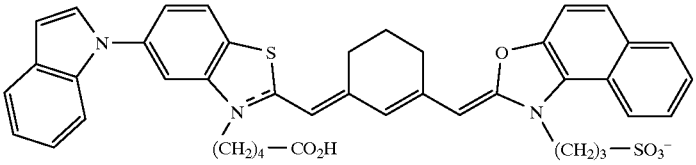

-continued
(I)-36
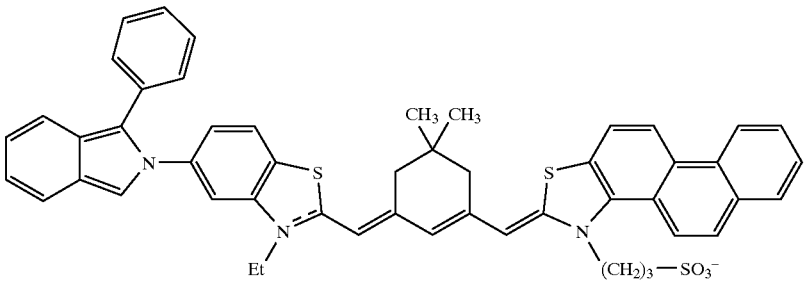
(I)-37
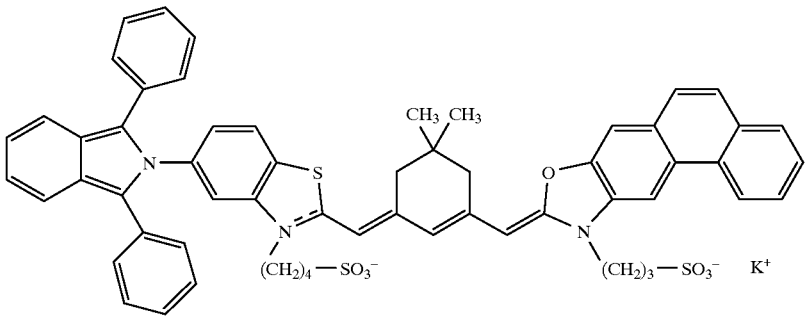
(I)-38
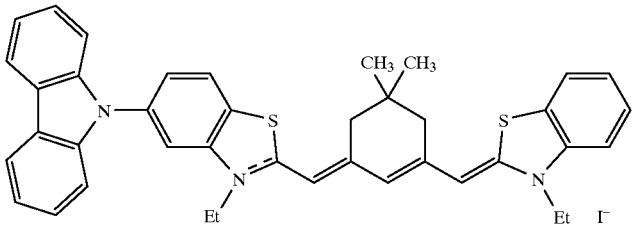
(I)-39
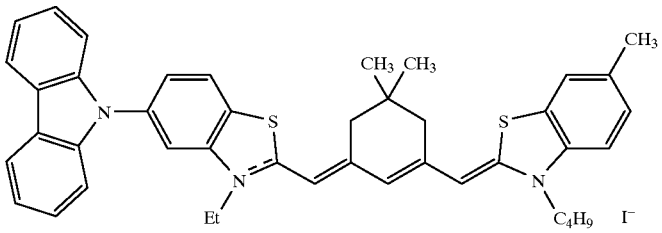
(I)-40
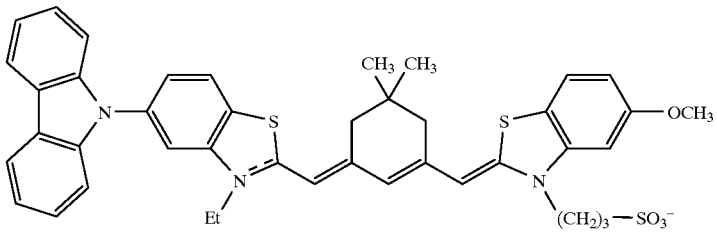

-continued
(I)-41
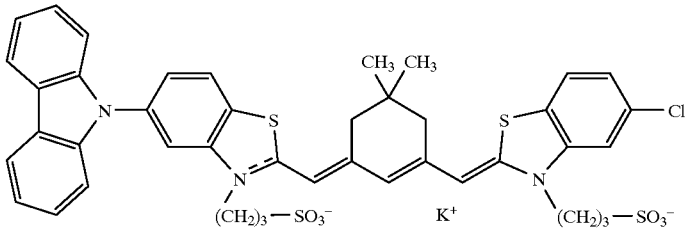
(I)-42
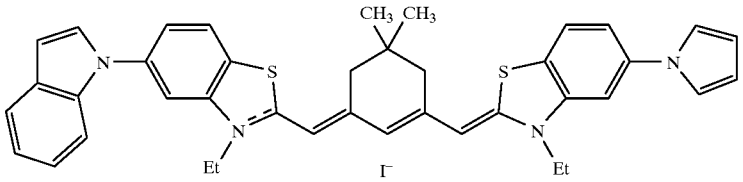
(I)-43
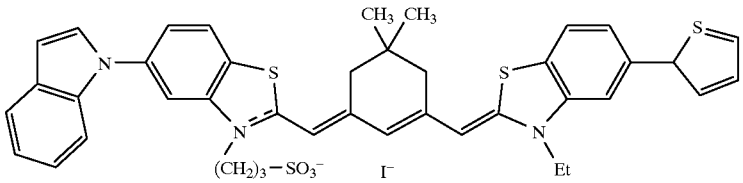
(I)-44
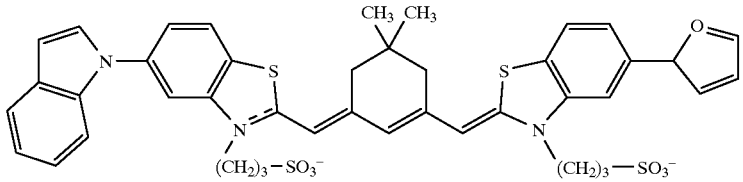
(I)-45
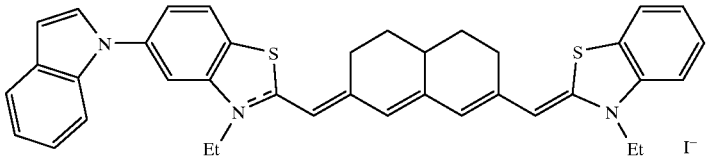
(I)-46
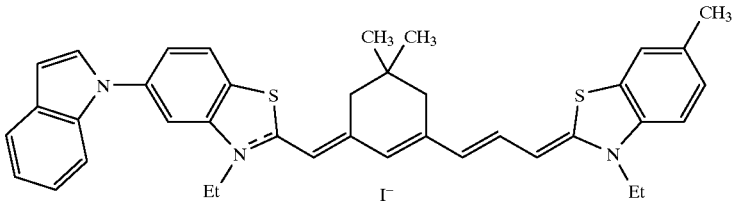
(I)-47
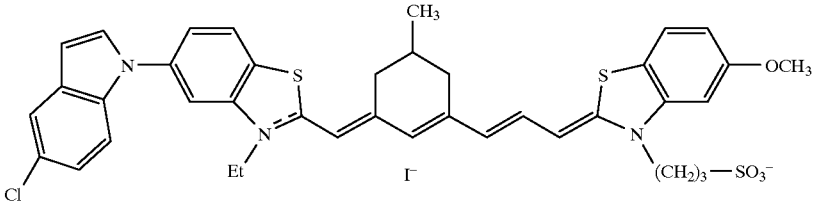

-continued
(I)-48
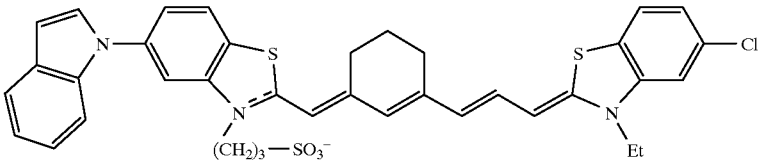
(I)-49
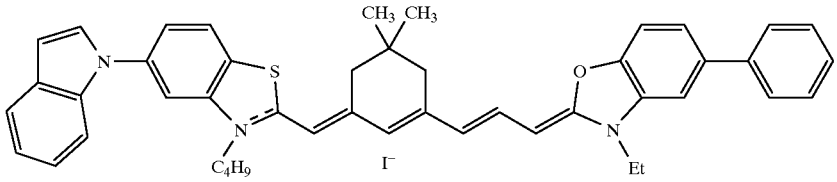
(I)-50
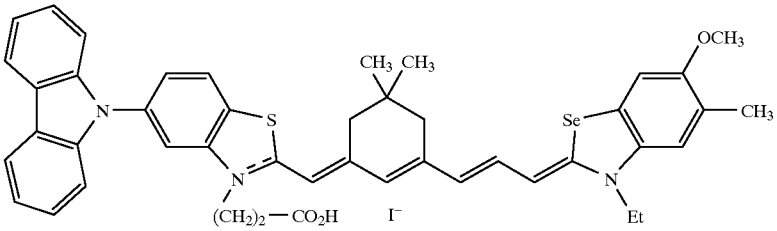
(I)-51
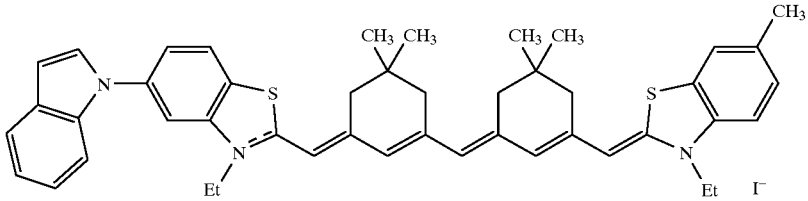

Synthesis of the dye (I)-23

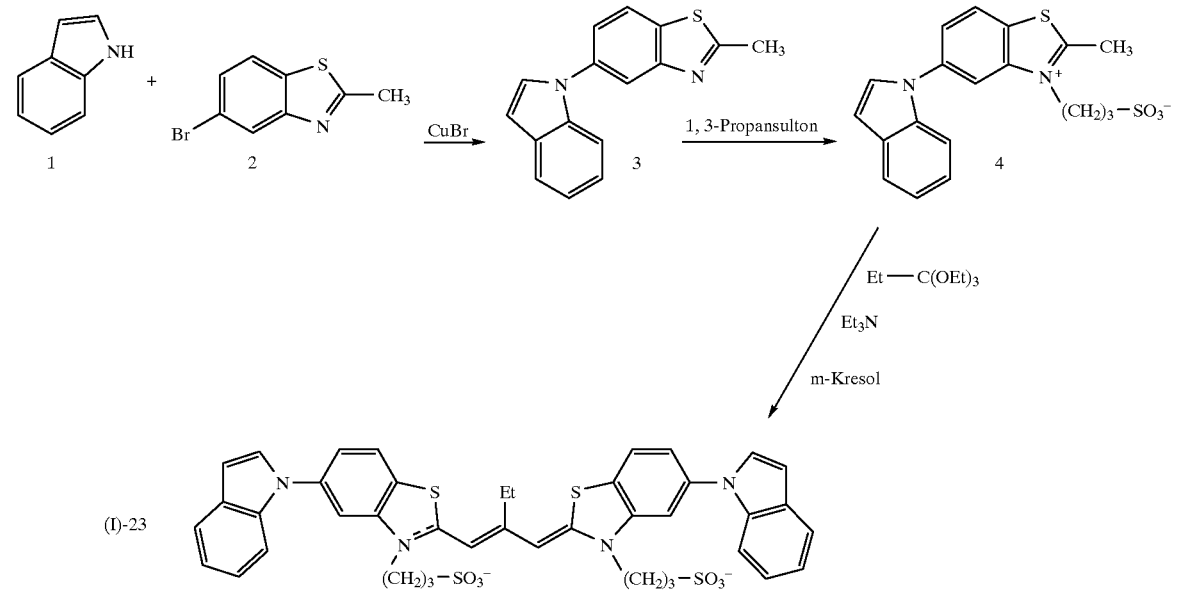

The synthesis of 3 from 1 and 2 was carried out similarly to the method described in J. Chem. Soc., Perkin Trans. 1, 1989, 2407.

Preparation of the quaternary salt 4

2.64 g (10 mmol) 3 is heated for 6 hours at 160° C. in 5 ml dichlorobenzene together with 1.22 g (10 mmol) 1,3-propane sultone. The mixture is cooled to room temperature and then 30 ml acetone is added. This is followed by refluxing for 0.5 hours, allowing to cool to room temperature, filtering under suction, thorough washing with acetone and, without intermediate drying, boiling with 30 ml methanol for 1 hour.

Yield: 2.68 g (69.3% of theoretical yield)

Preparation of the dye (I)-23

1.93 g (10 mmol) 4 is dissolved hot in 10 ml m-cresol, 5.29 g (30 mmol) triethyl orthopropionate is added thereto at an internal temperature of about 100° C. and the mixture is stirred for 15 minutes at 100° C. After the mixture has been cooled to room temperature, a solution of 1.93 g (10 mmol) 4, dissolved in 10 ml m-cresol, is added and 1.78 ml (12.8 mmol) triethylamine is introduced over a period of 5 minutes at room temperature. After having been stirred for 2 hours at room temperature, the dye solution is transferred over a period of 45 minutes into 75 ml acetone. The dye is allowed to crystallise out overnight, filtered under suction and thoroughly washed with acetone. The crude dye is dissolved hot in 60 ml methanol, filtered hot and 30 ml acetone is added thereto. The dye is allowed to crystallise out overnight, filtered under suction and thoroughly washed with acetone. After drying to constant weight at 50° C. in a vacuum, 5.02 g (55% of theoretical yield) of dye is obtained.

The cyanines according to the invention may also be successfully prepared by applying the methods of synthesis described in "THE CYANINE DYES AND RELATED COMPOUNDS" by Frances M. Hamer, Interscience Publishers (1964).

By means of the sensitising dyes according to the invention, a sensitisation is attained which not only leads to high sensitivity but is also stable in the green spectral range between 530 and 590 nm, in the red spectral range between 600 and 680 nm or 680 to 750 nm and in the infrared spectral range.

Still higher sensitivity is achieved when one or two cyanine dyes corresponding to formula II below are added to a cyanine dye corresponding to formula I:

(II)

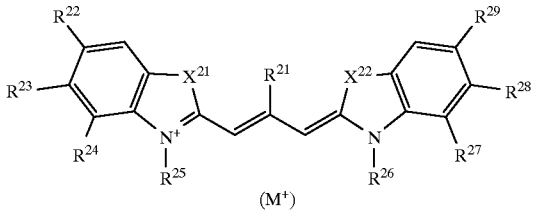

wherein $X^{21}$, $X^{22}$ denote —O—, —S—, —Se— or —$NR^{10}$ ($R^{10}$= alkyl, preferably ethyl);

$R^{21}$ denotes H, methyl or ethyl;

$R^{22}$, $R^{23}$, $R^{24}$, $R^{27}$, $R^{28}$, $R^{29}$ denote H, halogen (preferably chlorine), —CN, —$CF_3$, alkyl (preferably methyl), alkoxy (preferably methoxy) or aryl (preferably unsubstituted phenyl or phenyl substituted, for example, with halogen or alkyl);

or $R^{23}$ together with $R^{22}$ or $R^{24}$, or $R^{28}$ together with $R^{27}$ or $R^{29}$ denote groups required to complete an optionally substituted naphthoazole, anthraazole or phenanthroazole;

$R^{25}$ and $R^{26}$ (alike or different) denote: alkyl, sulphoalkyl, carboxyalkyl, —$(CH_2)_n$—$SO_2$—NH—$SO_2$-alkyl, —$(CH_2)_n$—$SO_2$—NH—CO-alkyl, —$(CH_2)_n$—CO—NH—$SO_2$-alkyl, or —$(CH_2)_n$—CO—NH—CO-alkyl (n=1–6);

$M^+$ denotes a cation which may if necessary be required to equalise the charge.

Suitable sensitising dyes are:
(II)-1
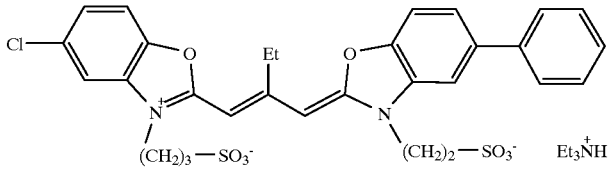
(II)-2
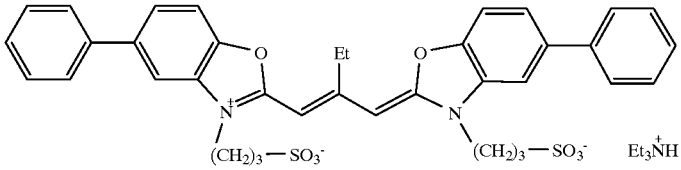
(II)-3
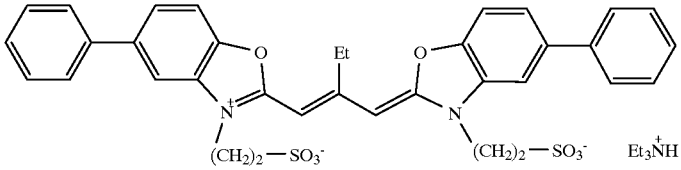
(II)-4
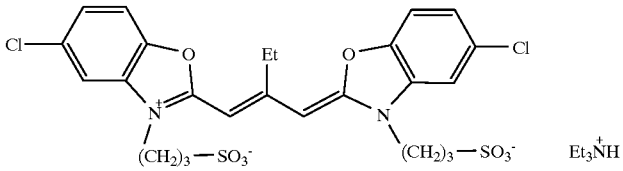
(II)-5
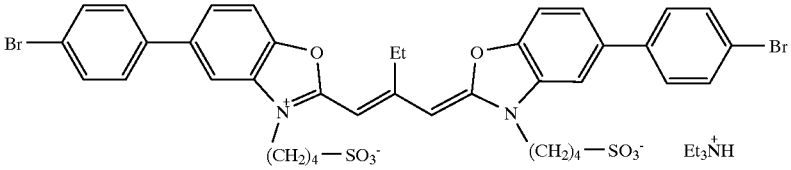
(II)-6
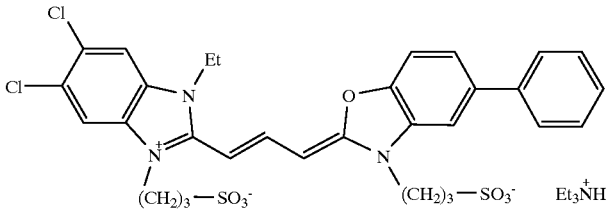
(II)-7
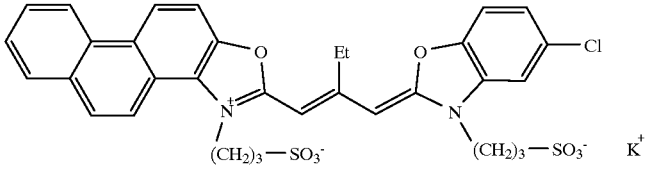

-continued
(II)-8
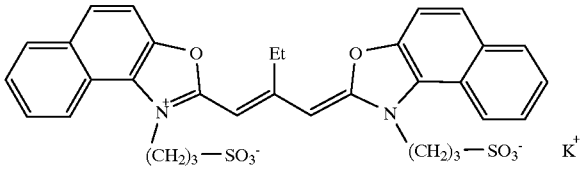
(II)-9
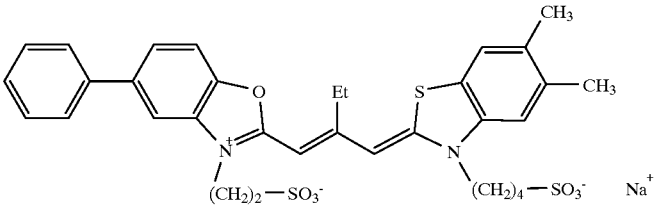
(II)-10
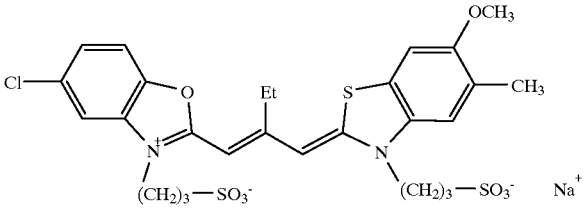
(II)-11
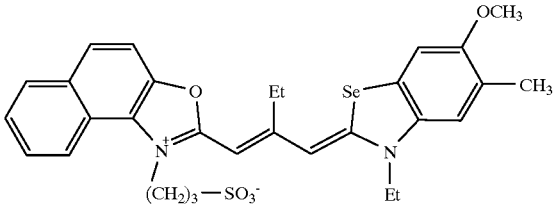
(II)-12
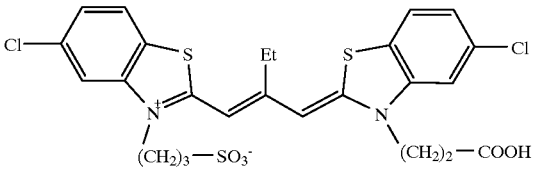
(II)-13
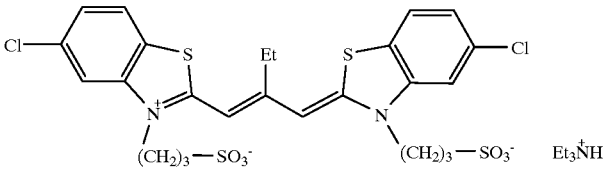
(II)-14
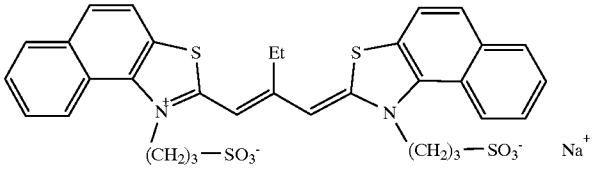

-continued (II)-15

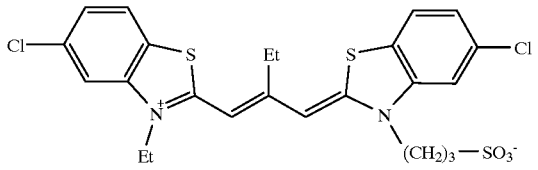

(II)-16

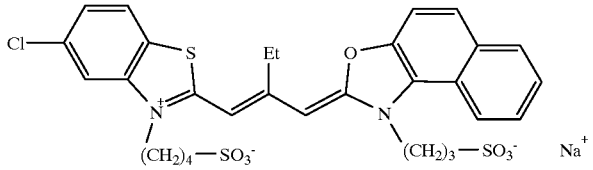

Examples of colour photographic materials are colour negative films, colour reversal films, colour positive films, colour photographic paper, colour reversal photographic paper, colour sensitive materials for the colour diffusion transfer process or the silver colour bleaching process.

The photographic materials consist of a support, to which at least one light-sensitive silver halide emulsion layer is applied. Thin films and foils are particularly suitable as supports. A survey of support materials and of auxiliary layers applied to the front and reverse sides thereof is published in Research Disclosure 37254, Part 1 (1995), page 285.

The colour photographic materials generally contain at least one each of a red-sensitive, a green-sensitive and a blue-sensitive silver halide emulsion layer and optionally intermediate layers and protective layers.

These layers may be arranged differently, depending on the type of photographic material. For the most important products this arrangement may be as follows:

Colour photographic films such as colour negative films and colour reversal films contain, in the following order on the support, 2 or 3 red-sensitive, blue-green coupling silver halide emulsion layers, 2 or 3 green-sensitive, purple-coupling silver halide emulsion layers and 2 or 3 blue-sensitive, yellow-coupling silver halide emulsion layers. The layers of equal spectral sensitivity differ in their photographic sensitivity, the less sensitive constituent layers as a rule being arranged closer to the support than are the more sensitive layers.

A yellow filter layer, which prevents blue light from entering the underlying layers, is generally placed between the green-sensitive and blue-sensitive layers.

The possible alternatives for different layer arrangements and their effects on the photographic properties are described in J. Inf. Rec. Mats., 1994, Vol. 22, pages 183 to 193.

Colour photographic paper, which as a rule is far less light-sensitive than a colour photographic film, usually contains on the support, in the following order, one each of a blue-sensitive, yellow-coupling silver halide emulsion layer, a green-sensitive, purple-coupling silver halide emulsion layer and a red-sensitive, blue-green coupling silver halide emulsion layer; the yellow filter layer may be omitted.

Deviations from the number and arrangement of the light-sensitive layers may be made in order to achieve certain results. For example, in a photographic film all the highly sensitive layers may be combined to form a single pack and all the layers of low sensitivity may be combined to form another pack in order to increase the sensitivity (DE 25 30 645).

Important components of the photographic emulsion layers are binders, silver halide grains and colour couplers.

Information regarding suitable binders may be found in Research Disclosure 37254, Part 2 (1995), page 286.

Information regarding suitable silver halide emulsions, their preparation, ripening, stabilisation and spectral sensitisation including suitable spectral sensitisers may be found in Research Disclosure 37254, Part 3 (1995), page 286 and in Research Disclosure 37038, Part XV (1995), page 89.

Camera-sensitive photographic materials generally contain silver bromide iodide emulsions, which optionally may also contain small quantities of silver chloride. Photographic copying materials contain either silver chloride bromide emulsions having up to 80 mol % AgBr or silver chloride bromide emulsions having more than 95 mol % AgCl.

Information regarding the colour couplers may be found in Research Disclosure 37254, Part 4 (1995), page 288 and in Research Disclosure 37038, Part II (1995), page 80. The maximal absorption of the dyes formed from the couplers and the colour developer oxidation product is preferably within the following ranges: yellow coupler, 430 to 460 nm; purple coupler, 540 to 560 nm; blue-green coupler, 630 to 700 nm.

In colour photographic films, in order to improve sensitivity, graininess, sharpness and colour separation, compounds are frequently used which, during the reaction with the developer oxidation product, release other compounds which are photographically active, for example, DIR couplers which release a developer inhibitor.

Information on such compounds, in particular couplers, may be found in Research Disclosure 37254, Part 5 (1995), page 290 and in Research Disclosure 37038, Part XIV (1995), page 86.

Most hydrophobic colour couplers, and also other hydrophobic components of the layers, are generally dissolved or dispersed in high-boiling organic solvents. These solutions or dispersions are then emulsified in an aqueous binding agent (usually gelatine solution) and, after the layers have been dried, are present as fine droplets (0.05 to 0.8 $\mu$m in diameter) in the layers.

Suitable high-boiling organic solvents, methods for introducing a photographic material into the layers and additional methods for introducing chemical compounds into photographic layers may be found in Research Disclosure 37254, Part 6 (1995), page 292.

The light-insensitive intermediate layers, which are usually arranged between layers having different spectral sensitivity, may contain agents which prevent an undesirable diffusion of developer oxidation products out of one light-sensitive layer into another light-sensitive layer having a different spectral sensitisation.

Suitable compounds (white couplers, scavengers or EOP traps) may be found in Research Disclosure 37254, Part 7 (1995), page 292 and in Research Disclosure 37038, Part III (1995), page 84.

The photographic material may also contain UV light-absorbing compounds, optical bleaches, spacers, filter dyes, formalin traps, light stabilisers, antioxidants, $D_{min}$ dyes; additives for improving the dye stability, coupler stability and whiteness stability and for decreasing the colour fogging; plasticisers (latexes), biocides and other substances.

Suitable compounds may be found in Research Disclosure 37254, Part 8 (1995), page 292 and in Research Disclosure 37038, Parts IV, V, VI, VII, X, XI and XIII (1995), page 84 ff.

The layers of colour photographic materials are generally cured, that is, the binder used, preferably gelatine, is cross-linked by means of suitable chemical processes.

Suitable curing agents may be found in Research Disclosure 37254, Part 9 (1995), page 294 and in Research Disclosure 37038, Part XII (1995), page 86.

After imagewise exposure to light, colour photographic materials are processed by various methods appropriate to their nature. Details regarding the procedures and the chemicals required for them are published in Research Disclosure 37254, Part 10 (1995), page 294 and in Research Disclosure 37038, Parts XVI to XXIII (1995), page 95 ff., together with examples of materials.

EXAMPLES

Example 1

A light-sensitive photographic material was prepared as follows, using the sensitising dye I-23.

41.3 mg of a stabiliser ST, dissolved in 6.88 g water and 0.12 g NaOH, is added to 100 g of a silver bromide emulsion containing 10 mol % AgI and having a wide particle size distribution, centred around 1.41 μm size. After the mixture has been stirred for 45 minutes at 45° C., 24.5mg I-23 (26.8 μmol) dissolved in 25 ml methanol is added and stirring is continued for 15 minutes at 40° C. Subsequently 20 mg ST-A, dissolved in 4 g water, is added and the mixture is stirred for 10 minutes at 40° C. 1.26 g of the coupler K-1 together with 1.89 g of the coupler K-2, emulsified in 50.4 g water, 3.15 g tricresyl phosphate and 0.22 g wetting agent WA, are then added with stirring. After addition of 120.0 ml 5 wt. % aqueous gelatine and 100 ml water, a further 81 mg of wetting agent WA, dissolved in a mixture of 1.6 ml water and 0.4 ml methanol, is introduced. After a further 15 minutes the emulsion is poured off and subsequently cured.

K-1

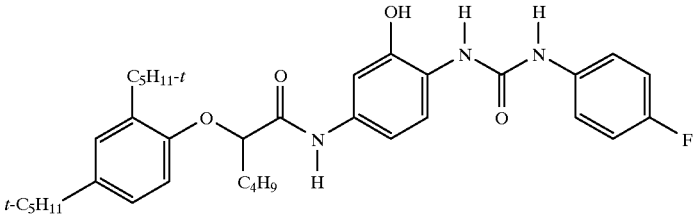

K-2

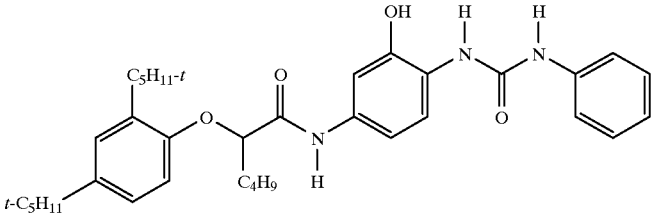

ST

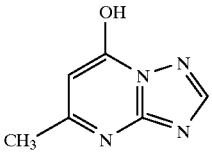

ST-A

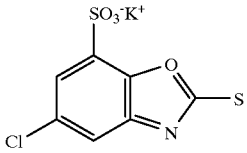

-continued

NM

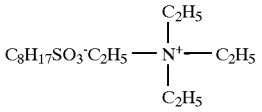

Further materials were prepared in the same manner, except that other sensitising dyes were used instead of the sensitising dye I-23 according to the invention; the same quantity of dye (26.8 μmol) was used in all cases. The results are shown in Table 1. The sensitivity of the materials thus prepared was determined. For this purpose, samples of the materials were exposed behind a graduated wedge and subjected to a colour-negative processing as described in "The Journal of Photographic Science, 1974, pages 597, 598".

TABLE 1

*Sensitivity standardised to that of I-23.

| Dye | Sensitivity* | Sample type |
|---|---|---|
| (I)-3 | 0.93 | Invention |
| (I)-11 | 0.99 | Invention |
| (I)-2 | 0.93 | Invention |
| (I)-14 | 1.00 | Invention |
| (I)-23 | 1.00 | Invention |
| V-1 | 0.78 | Comparison |
| V-2 | 0.81 | Comparison |
| V-3 | 0.83 | Comparison |
| V-4 | 0.88 | Comparison |
| V-5 | 0.90 | Comparison |

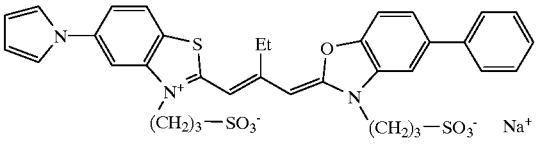

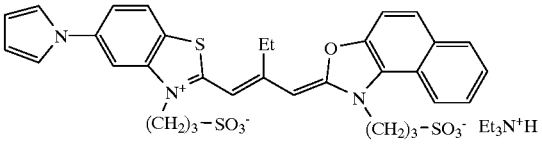

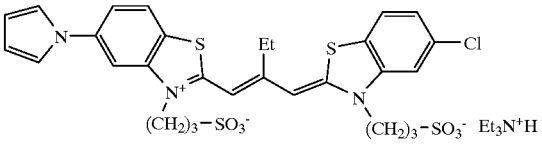

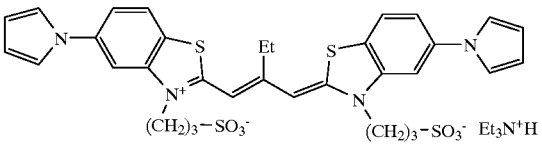

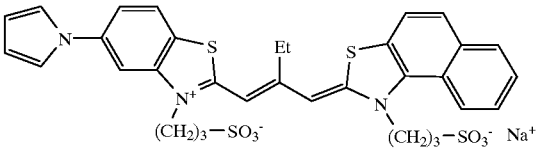

TABLE 1-continued

*Sensitivity standardised to that of I-23.

| Dye | Sensitivity* | Sample type |
|---|---|---|

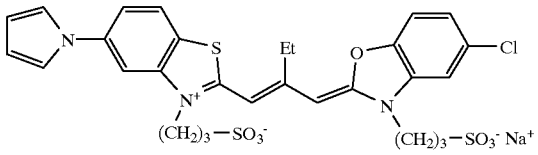

Example 2

As described in Example 1, the sensitivities were determined for correspondingly prepared materials, which were additionally sensitised with one sensitising dye corresponding to formula I or formula II. The total quantity of each pair of dyes and that of the comparison combinations is 26.8 μmol. The sensitivity values achieved are shown in Table 2.

TABLE 2

*Sensitivity standardised to that of the combination (I)-3/(I)-23.

| Dye mixture | Mixing ratio | Sensitivity* | Sample type |
|---|---|---|---|
| (I)-3/(I)-11 | 1/1 | 0.96 | Invention |
| (I)-2/(I)-11 | 1/2 | 0.98 | Invention |
| (I)-3/(I)-23 | 1/2 | 0.98 | Invention |
| (I)-3/(II)-15 | 1/2.5 | 1.00* | Invention |
| (I)-2/(II)-13 | 1/3 | 0.92 | Invention |
| (II)-16/(I)-23 | 1/2 | 0.90 | Invention |
| V-2/V-3 | 1/1 | 0.86 | Companson |
| V-1/V-3 | 1/2 | 0.88 | Comparison |
| V-2/V-4 | 1/2.5 | 0.85 | Comparison |
| V-2/(II)-15 | 1/3 | 0.87 | Comparison |
| V-1/(II)-13 | 1/2 | 0.83 | Comparison |
| (II)-16/V-4 | 1/1 | 0.92 | Comparison |

Example 3

As described in Example 1, the sensitivities were determined for correspondingly prepared materials which were additionally sensitised with one or two sensitising dyes corresponding to formula II or additionally sensitised with one or two sensitising dyes corresponding to formula I. The total quantity of all three sensitisers in each mixture of three is standardised to 26.8 μmol.

The sensitivity of the materials thus prepared was determined. The sensitivity values achieved are shown in Table 3.

TABLE 3

*Sensitivity standardised to that of the combination (I)-1/(I)-23/(I)-14.

| Dye mixture | Mixing ratio | Sensitivity* | Sample type |
|---|---|---|---|
| (I)-1/(I)-23/(I)-14 | 1/3/0.5 | 1.00* | Invention |
| (I)-2/(I)-23/(II)-14 | 1/3/0.5 | 0.98 | Invention |

TABLE 3-continued

*Sensitivity standardised to that of the combination (I)-1/(I)-23/(I)-14.

| Dye mixture | Mixing ratio | Sensitivity* | Sample type |
|---|---|---|---|
| (II)-16/(I)-23/(II)-14 | 1/3/0.5 | 0.95 | Invention |
| (II)-11/(I)-11/(I)-14 | 1/3/0.5 | 0.97 | Invention |
| (II)-11/(I)-11/(II)-14 | 1/3/.02 | 0.94 | Invention |
| V-3/V-4/V-5 | 1/3/0.5 | 0.86 | Companson |
| V-I/V-4/(II)-14 | 1/3/0.5 | 0.83 | Companson |
| (II)-16/V-4/(II)-14 | 1/3/0.5 | 0.80 | Comparison |
| (II)-11/V-3/V-5 | 1/3/0.5 | 0.82 | Comparison |
| (II)-11/V-3/II)-14 | 1/3/.02 | 0.77 | Comparison |

Example 4

A light-sensitive material was prepared as follows, using the mixture of three sensitisers (II)-1/(II)-17/(I)-1:

413 mg of a stabiliser ST, dissolved in 68.8 g water and 1.2 g NaOH, is added to 1 kg of a silver bromide emulsion containing 10 mol % AgI (silver content expressed in $AgNO_3$: 201 g per kg emulsion) and having a wide particle size distribution, centred around 1.41 μm size. After the mixture has been stirred for 45 minutes at 45° C., 145.5 mg (194.9 μmol) (II)-1, 0.1% dissolved in phenoxyethanol/methanol=2/8, is added; after a further stirring for 30 minutes at 40° C., 27.0 mg (48.7 μmol) (II)-17 dissolved in the above solvent mixture and concentration is added and once again stirred for 30 minutes at 40° C., after which 18.0 mg (24.4 μmol) (I)-1 in the above solvent mixture and concentration was added. Subsequently 200 mg ST-A, dissolved in 40 g water, is added and the mixture is stirred for 10 minutes at 40° C. 40 g of the coupler K-3 emulsified in 580 g water and 40 g tricresyl phosphate is then added with stirring. After addition of 1200 mg of 5 wt. % aqueous gelatine, a further 810 mg of wetting agent WA, dissolved in a mixture of 16 ml water and 4 ml methanol, is introduced. After a further 15 minutes the emulsion is poured off and subsequently cured.

Photographic Science, 1974, pages 597, 598". The results are listed in Table 4.

TABLE 4

*Sensitivity standardised to that of the combination (II)-1/(II)-17/(I)-2.

| Dye mixture | Mixing ratio | Sensitivity* | Sample type |
|---|---|---|---|
| (II)-1/(II)-17/(I)-1 | 4/1/0.5 | 0.99 | Invention |
| (II)-1/(II)-17/(I)-2 | 4/1/0.5 | 1.00* | Invention |
| (II)-1/(II)-8/(I)-1 | 4/1/0.5 | 0.95 | Invention |
| (II)-1/(II)-8/(I)-2 | 4/1/0.5 | 0.97 | Invention |
| (II)-1/(II)-17/(I)-1 | 4/1/1 | 0.99 | Invention |
| (II)-1/(II)-17/V-1 | 4/1/0.5 | 0.87 | Comparison |
| (II)-1/(II)-17/V-6 | 4/1/0.5 | 0.86 | Comparison |
| (II)-1/(II)-8/V-1 | 4/1/0.5 | 0.86 | Comparison |
| (II)-1/(II)-18/V-6 | 4/1/0.5 | 0.90 | Comparison |
| (II)-1/(II)-17/V-1 | 4/1/1 | 0.92 | Comparison |

Example 5

Preparation of emulsion and sensitisation

The following solutions were prepared, using dimineralised water in each case:

| | | |
|---|---|---|
| Solution 1 | 4,000 g | Water |
| | 500 g | Gelatine |
| Solution 2 | 6,700 g | Water |
| | 1,300 g | NaCl |
| | 0.4 mg | $K_2IrCl$ |
| | 0.2 mg | $Na_3RhCl_6$ |
| Solution 3 | 6,500 g | Water |
| | 3,600 g | $AgNO_3$ |

Solution 2 and solution 3 are added simultaneously at 45° C., with intensive stirring, over a period of 70 minutes at a pAg of 7.7 to solution 1. A silver chloride emulsion having an average particle diameter of 0.5 μm is obtained. The weight ratio of gelatine to $AgNO_3$ is 0.14. The emulsion is ultrafiltered in a known manner, washed and redispersed using gelatine in a quantity such that the weight ratio of

K-3

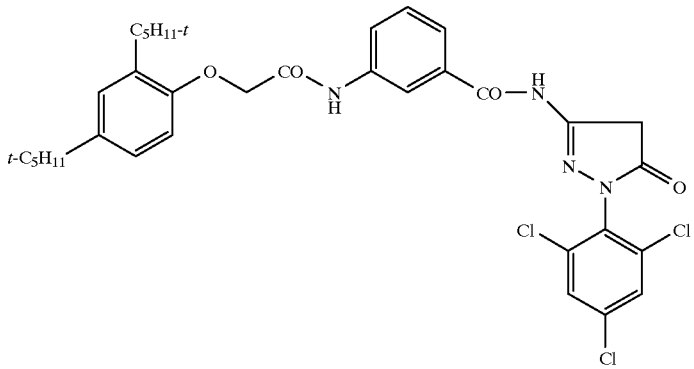

Further materials were prepared in the same manner, except that other sensitising mixtures were used instead of the above sensitising mixture, as may be seen from Table 4. The sum of all three sensitisers in each mixture of three is standardised to 268 μmol.

The sensitivity of the materials thus prepared was determined. For this purpose, samples of the materials were exposed behind a graduated wedge and subjected to a colour-negative processing as described in "The Journal of gelatine to $AgNO_3$ is 0.56. The silver halide content is 1.5 mol per kg of emulsion. 18 μmol gold(III) chloride/mol $AgNO_3$ and 7 μmol $Na_2S_2O_3$/mol $AgNO_3$ is added, with stirring, to the emulsion at a pH value of 5.3. After 5 minutes, 200 mg of compound A is added and the emulsion is then ripened for 3 hours at 70° C., with stirring. After being cooled to 50° C., the emulsion is spectrally sensitised by addition of 215.8 mg/kg $AgNO_3$ of (I)-32 (dissolved in 0.1% methanol solution) and stabilised by addition of 2 g B/kg $AgNO_3$.

A

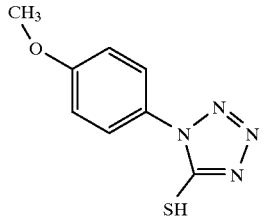

B

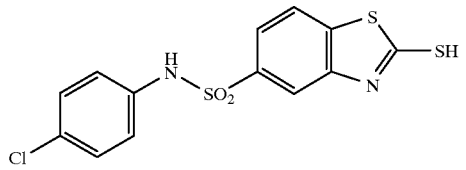

A photographic recording material containing the following layers is prepared on a paper support coated with polyethylene:

| | | |
|---|---|---|
| 1.) | Layer (red-sensitive, blue-green coupling) | |
| | Emulsion | 0.30 g/m$^2$ $AgNO_3$ |
| | Blue-green coupler K-BG | 0.42 g/m$^2$ |
| | Tricresyl phosphate | 0.42 g/m$^2$ |
| 2.) | Protective layer | |
| | Gelatine | 1.60 g/m$^2$ |
| 3.) | Curing layer | |
| | Curing agent H | 0.20 g/m$^2$ |

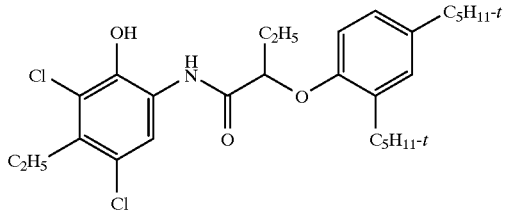

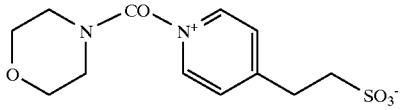

The material is exposed behind a step wedge for 40 ms and processed in the process AP 94.

The results are shown in Table 5.

TABLE 5

*Sensitivity standardised to that of I-32.

| Dye | Sensitivity* | Sample type |
|---|---|---|
| (I)-28 | 0.96 | Invention |
| (I)-30 | 0.95 | Invention |
| (I)-32 | 1.00* | Invention |
| V-7 | 0.86 | Comparison |
| V-8 | 0.88 | Comparison |
| V-9 | 0.91 | Comparison |

TABLE 5-continued

*Sensitivity standardised to that of I-32.

| Dye | Sensitivity* | Sample type |
|---|---|---|

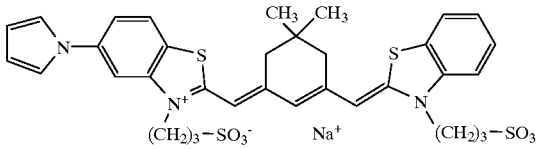

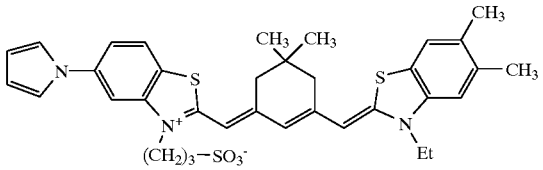

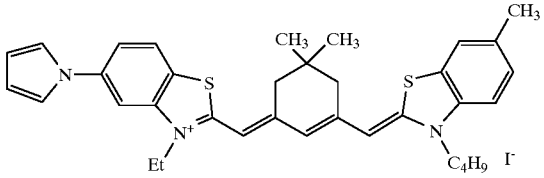

I claim:

1. A color photographic recording material which comprises at least one light-sensitive silver halide emulsion layer, the silver halide emulsion whereof is spectrally sensitized with a cyanine dye, said cyanine dye corresponds to formula I:

(I)

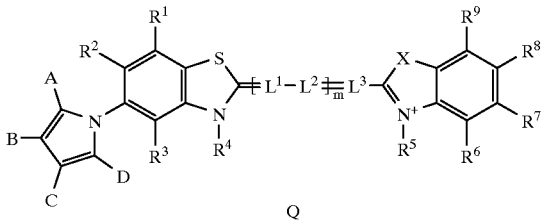

Q wherein:

$R^1$, $R^2$, $R^3$, $R^6$ to $R^9$ are the same or different and are H, halogen, alkyl, methoxy, aryl, 1-pyrrolyl, 2-pyrrolyl, 3-pyrrolyl, 2-furanyl, 3-furanyl, 2-thienyl, 3-thienyl, 1-indolyl, 2-isoindolyl or N-carbazolyl; or $R^7$ together with $R^6$ or $R^8$ denote the group required to complete an optionally substituted fused benzene ring or naphthalene ring system;

$R^4$ and $R^5$ are the same or different and are alkyl, sulphoalkyl, carboxyalkyl, —$(CH_2)_n$ —$SO_2$—NH—$SO_2$-alkyl, —$(CH_2)_n$—$SO_2$—NH—CO-alkyl, —$(CH_2)_n$—CO—NH—$SO_2$-alkyl, or —$CH_2)_n$—CO—NH—CO-alkyl (n=1–6);

X denotes —O—, —S—, —Se— or —$NR^{10}$ ($R^{10}$ is an optionally substituted alkyl);

$L^1$, $L^2$ and $L^3$ are the same or different and are substituted or unsubstituted methine groups, which may be constituents of one or more carbocyclic rings;

A denotes H, an aromatic group or, together with B, denotes the group required to complete a fused benzene ring;

B either together with A or together with C denotes the group required to complete a fused benezene ring;

C denotes H, an aromatic group, or together with B or D, denotes the group required to complete a fused benzene ring;

D denotes H, an aromatic group or, together with C, denotes the group required to complete a fused benzene ring;

Q denotes an anion or cation which optionally equalizes the charge;

m is 1, 2, 3 or 4.

2. The recording material according to claim 1, wherein the silver halide emulsion is additionally spectrally sensitized with at least one cyanine dye corresponding to formula II:

(II)

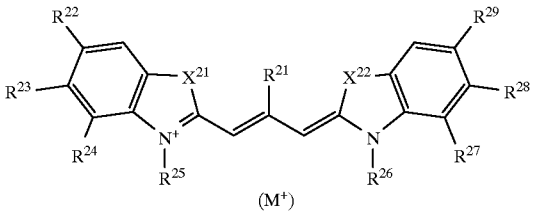

wherein $X^{21}$ *and* $X^{22}$ are the same or different and are —O—, —S—, —Se— or —$NR^{10}$ ($R^{10}$=alkyl);

$R^{21}$ denotes H, methyl or ethyl;

$R^{22}$, $R^{23}$, $R^{24}$, $R^{27}$, $R^{28}$, and $R^{29}$ are the same or different and are H, halogen, —CN, —$CF_3$, alkyl, alkoxy or aryl;

or $R^{23}$ together with $R^{22}$ or $R^{24}$, or $R^{28}$ together with $R^{27}$ or $R^{29}$, denote groups required to complete an optionally substituted naphthoazole, anthraazole or phenanthroazole;

$R^{25}$ and $R^{26}$ are the same or different and are alkyl, sulphoalkyl, carboxyalkyl, —$(CH_2)_n$—$SO_2$—NH—$SO_2$-alkyl, —$(CH_2)_n$—$SO_2$—NH—CO-alkyl, —$(CH_2)_n$—CO—NH—$SO_2$-alkyl, or —$(CH_2)_n$—CO—NH—CO-alkyl (n=1–6);

($M^+$) denotes a cation which optionally equalizes the charge.

3. The recording material according to claim 1, wherein the silver halide emulsion is additionally spectrally sensitized with at least one other cyanine dye corresponding to formula I.

4. The recording material according to claim 1, wherein the silver halide emulsion is spectrally sensitized with at least one cyanine dye corresponding to formula I, wherein m equals 2, and that the chloride content of the silver halide emulsion is at least 90 mol %.

5. The recording material according to claim 1, wherein the silver halide emulsion additionally contains the compound corresponding to formula B:

B

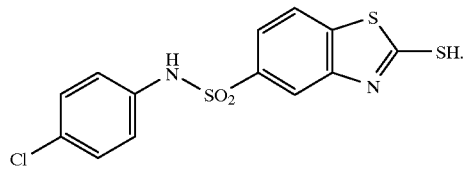

6. The recording material according to claim 5, wherein the silver halide emulsion additionally contains the compound corresponding to formula A:

A

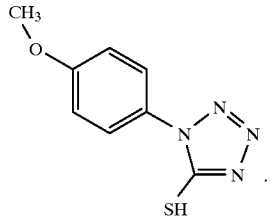

7. The recording material according to claim 1, wherein the silver halide emulsion is additionally spectrally sensitized with at least one cyanine dye corresponding to formula I, wherein m equals 3 or 4.

8. The recording material according to claim 1, wherein the cyanine dye is selected from the group consisting of

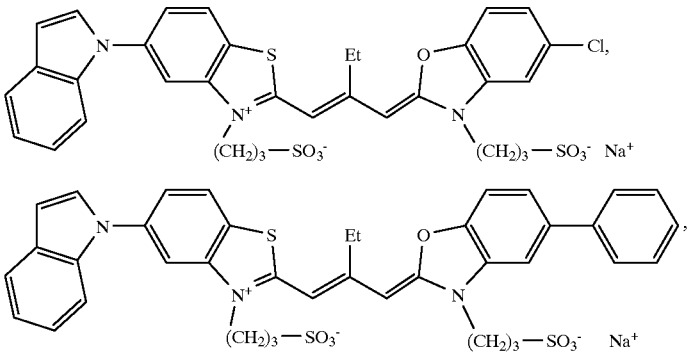

-continued
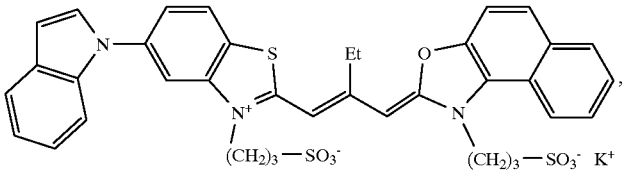
,
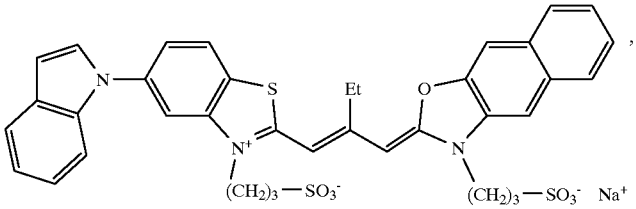
,
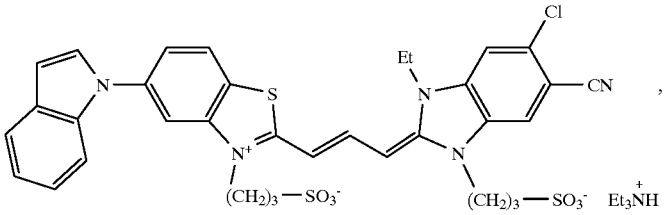
,
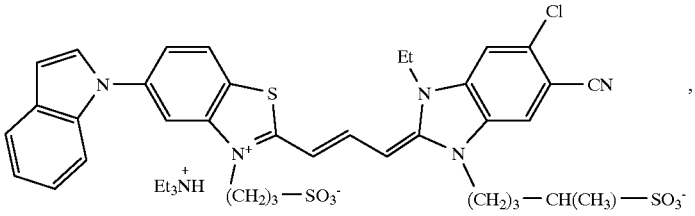
,
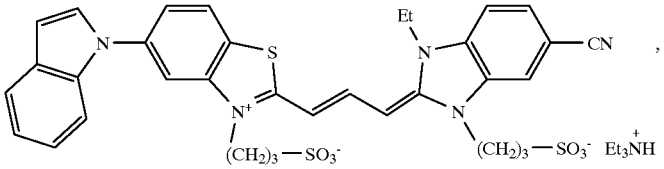
,
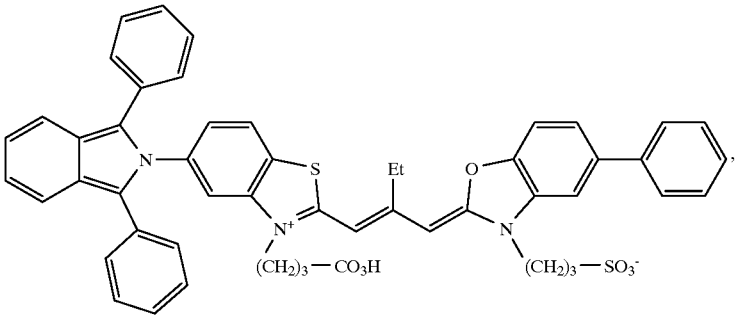
,
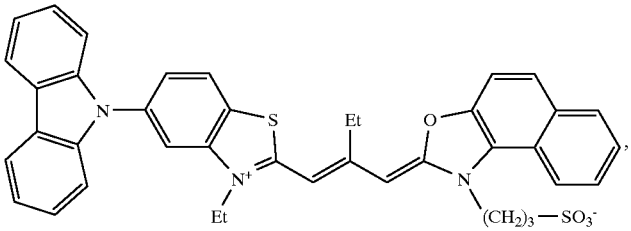
, -continued
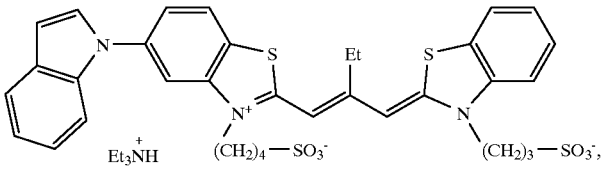
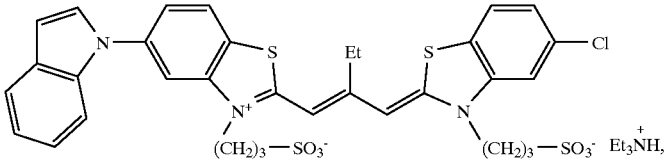
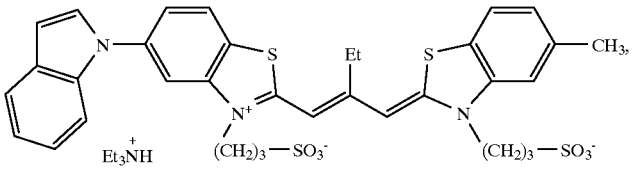
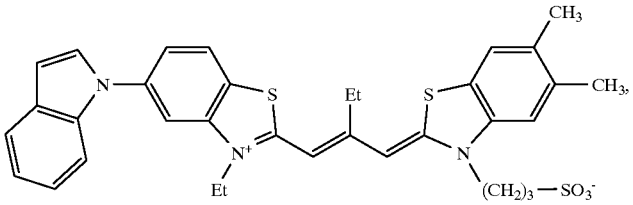
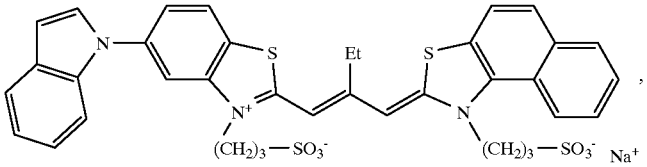
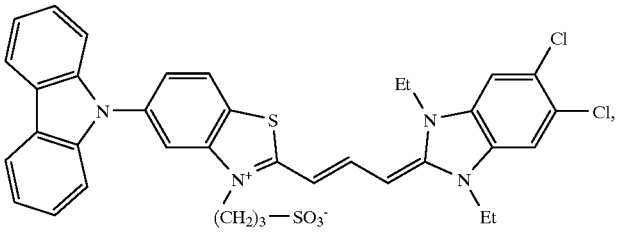
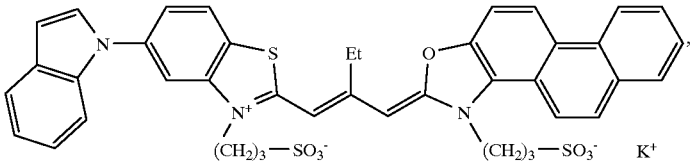
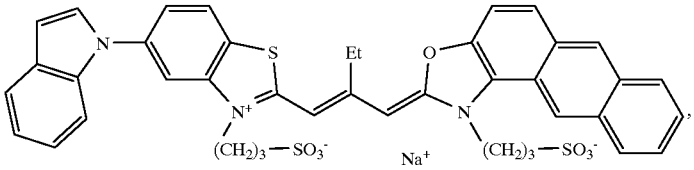
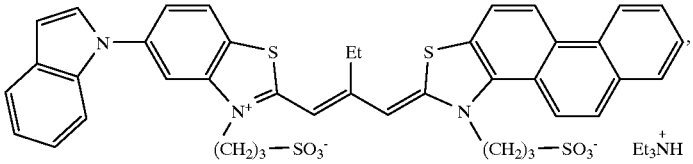

-continued
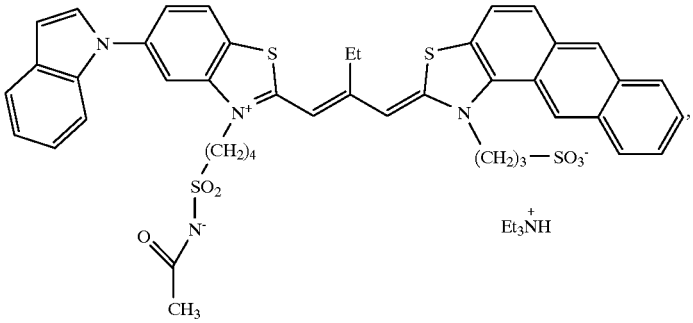
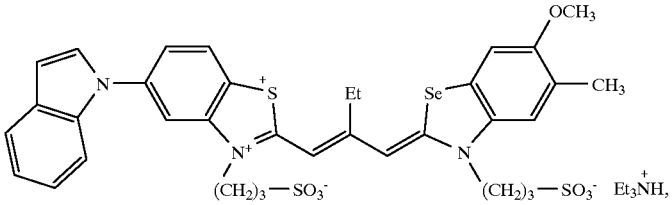
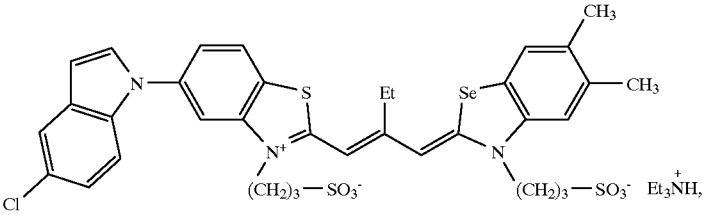
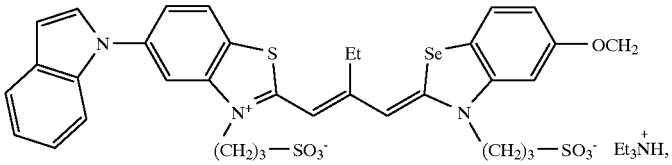
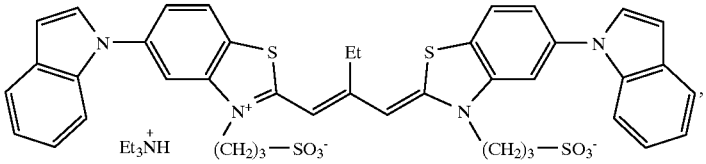
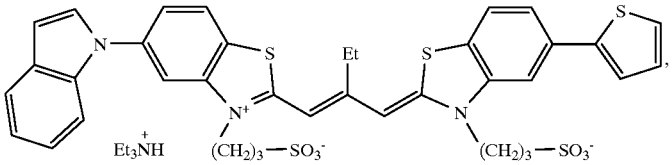
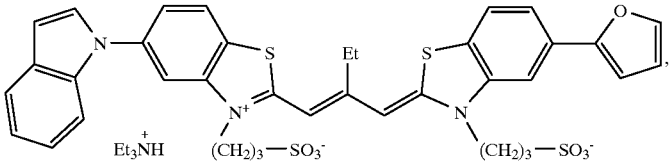
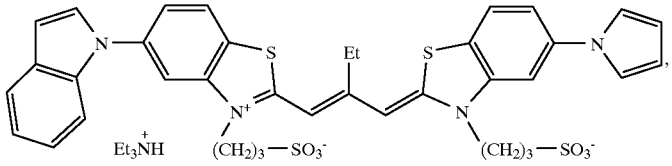

-continued
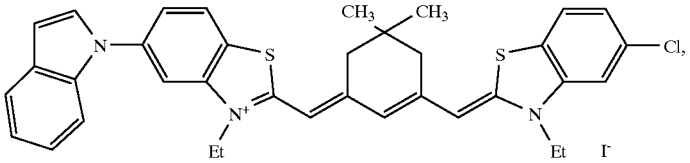
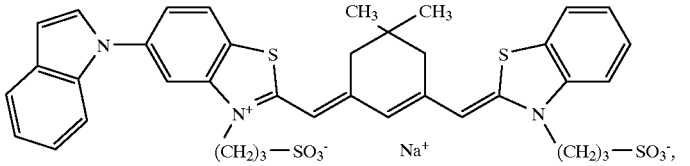
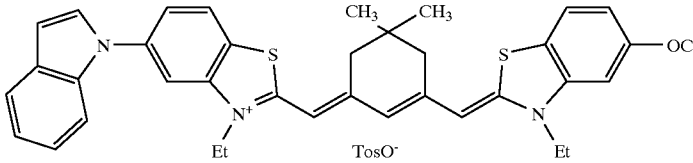
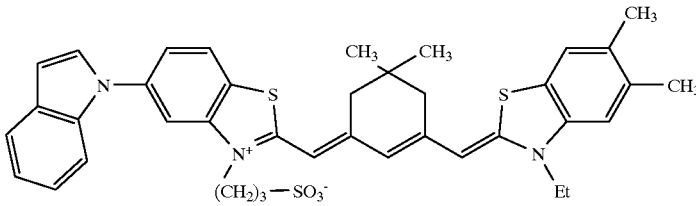
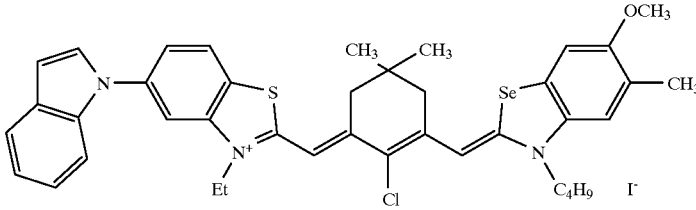
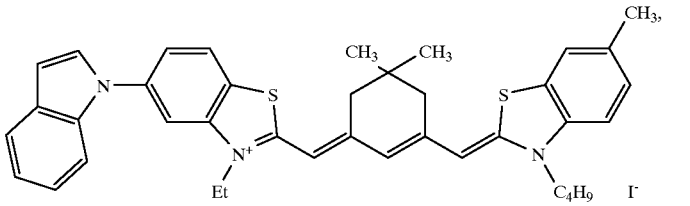
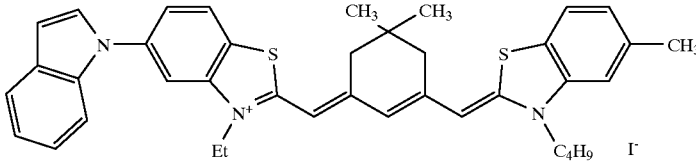
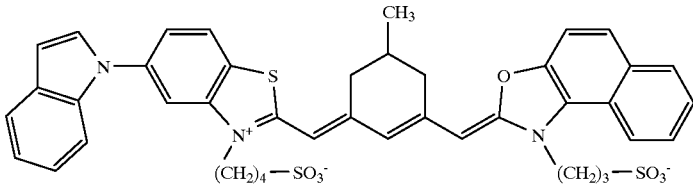
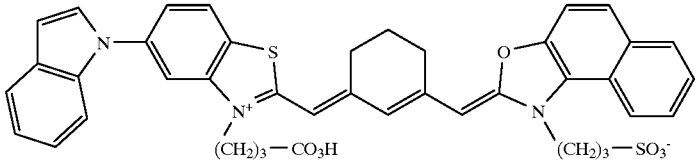

-continued
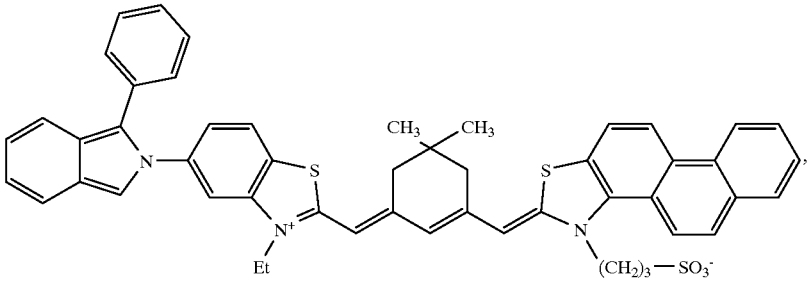
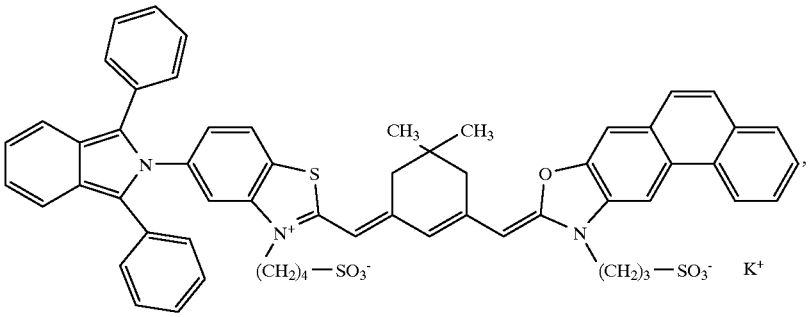
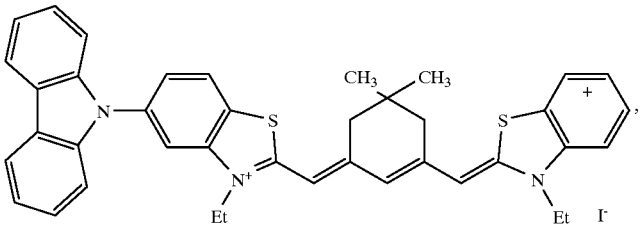
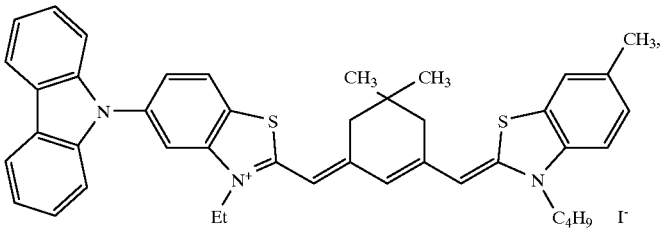
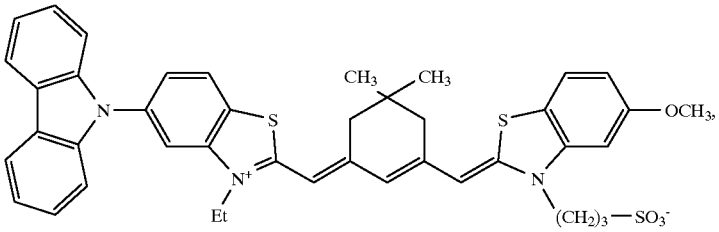
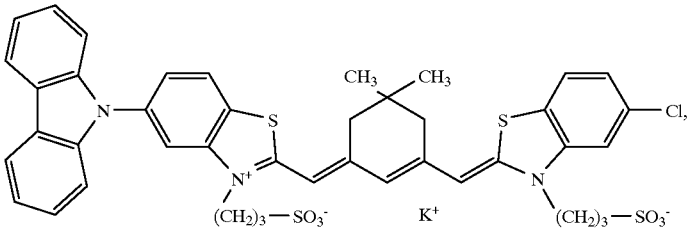

-continued
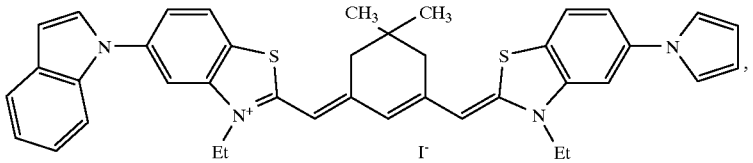
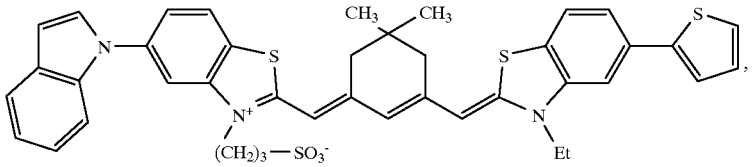
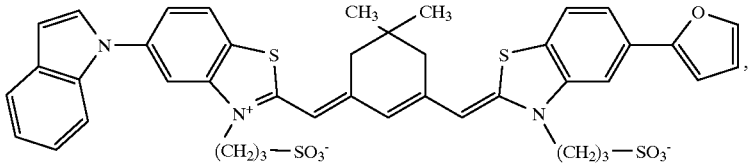
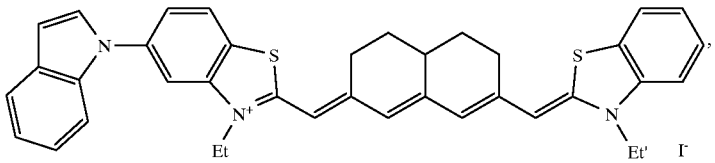
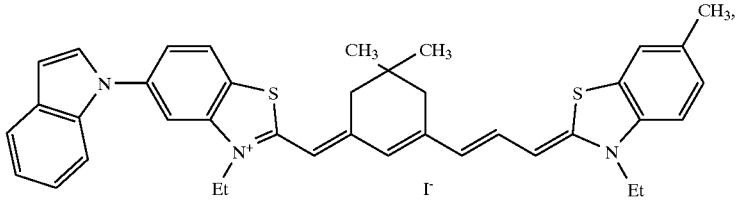
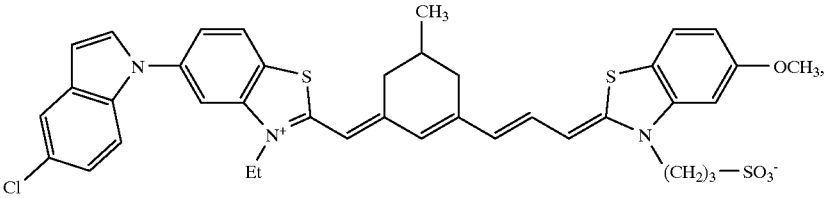
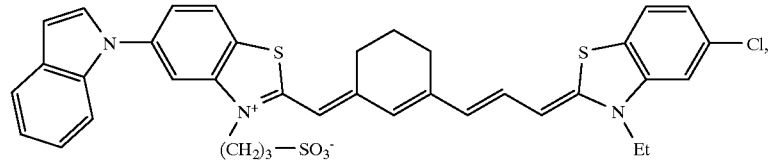
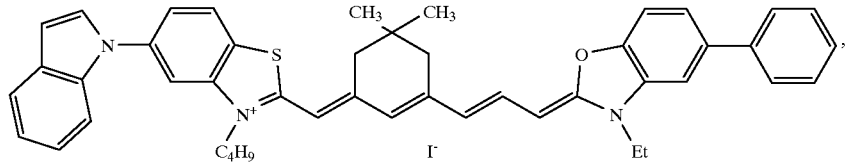
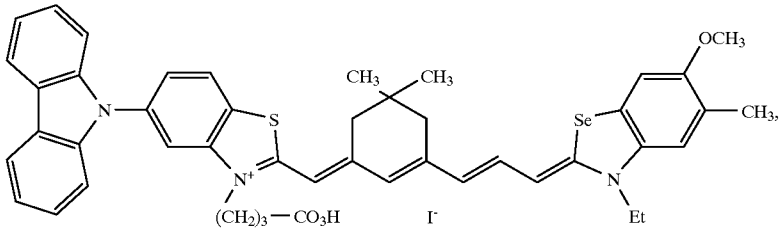

-continued
and
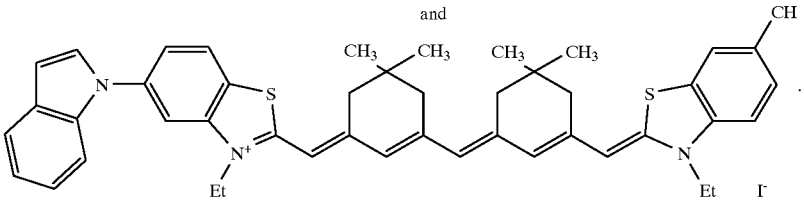
* * * * *